US009400463B2

(12) United States Patent
Wagatsuma et al.

(10) Patent No.: US 9,400,463 B2
(45) Date of Patent: Jul. 26, 2016

(54) IMAGE FORMING APPARATUS

(71) Applicant: Oki Data Corporation, Tokyo (JP)

(72) Inventors: Eiji Wagatsuma, Tokyo (JP); Tetsuya Watanabe, Tokyo (JP)

(73) Assignee: OKI DATA CORPORATION, Tokyo (JP)

( * ) Notice: Subject to any disclaimer, the term of this patent is extended or adjusted under 35 U.S.C. 154(b) by 0 days.

(21) Appl. No.: 14/799,152

(22) Filed: Jul. 14, 2015

(65) Prior Publication Data

US 2016/0018769 A1 Jan. 21, 2016

(30) Foreign Application Priority Data

Jul. 15, 2014 (JP) ..... 2014-144907
Nov. 25, 2014 (JP) ..... 2014-237584

(51) Int. Cl.
*G03G 15/20* (2006.01)

(52) U.S. Cl.
CPC ..... *G03G 15/2039* (2013.01); *G03G 15/2032* (2013.01); *G03G 15/2046* (2013.01); *G03G 2215/00455* (2013.01); *G03G 2215/2045* (2013.01)

(58) Field of Classification Search
CPC combination set(s) only.
See application file for complete search history.

(56) References Cited

U.S. PATENT DOCUMENTS

2009/0174888 A1 7/2009 Ko
2009/0252518 A1* 10/2009 Eun ..... G03G 15/657 399/68
2009/0317115 A1* 12/2009 Motoyama ..... G03G 15/2064 399/68
2010/0021194 A1* 1/2010 Toyohara ..... G03G 13/20 399/69
2010/0034548 A1 2/2010 Naitoh et al.
2011/0081158 A1 4/2011 Wagatsuma
2012/0263487 A1 10/2012 Itaya

FOREIGN PATENT DOCUMENTS

EP 0572050 A2 12/1993
EP 1470925 A1 10/2004
JP 2004-102104 A 4/2004
JP 2012-118140 A 6/2012

* cited by examiner

*Primary Examiner* — Clayton E Laballe
*Assistant Examiner* — Jas Sanghera
(74) *Attorney, Agent, or Firm* — Rabin & Berdo, P.C.

(57) ABSTRACT

An image forming apparatus includes a fixing unit including a fixing member that heats a developer for fixing the developer to a medium, a temperature control unit that heats the fixing member and controls a temperature of the fixing member, a transport member that transports the medium through the fixing unit, and a transport control unit that controls a transport speed at which the transport member transports the medium. At least one of before and after an image forming operation, the image forming apparatus performs a temperature control operation of the fixing unit while transporting the medium through the fixing unit. When the image forming apparatus performs the temperature control operation at least one of before and after the image forming operation, the transport control unit causes the transport member to transport the medium at a transport speed slower than a fastest transport speed among a plurality of preset transport speeds.

13 Claims, 11 Drawing Sheets

FIG. 7

163a

| ITEM | MEDIUM TYPE | MEDIUM WEIGHT |
|---|---|---|
| SETTING | LABEL | PLAIN PAPER |

FIG. 8

109a

| STATE OF APPARATUS | MEDIUM WEIGHT | TRANSPORT SPEED (ips) |
|---|---|---|
| PRINTING | PLAIN PAPER | 6 |
| | SLIGHTLY THICK PAPER | 5 |
| | THICK PAPER | 4 |
| | THICKER PAPER | 3 |
| | VERY THICK PAPER | 2 |
| WARMING-UP OPERATION | - | 2 |
| COOLING-DOWN OPERATION | - | 2 |

FIG. 9

| MEDIUM WEIGHT | BASIS WEIGHT W ($g/m^2$) |
|---|---|
| PLAIN PAPER | $W \leqq 83$ |
| SLIGHTLY THICK PAPER | $83 < W < 105$ |
| THICK PAPER | $105 \leqq W \leqq 120$ |
| THICKER PAPER | $120 < W \leqq 128$ |
| VERY THICK PAPER | $128 < W$ |

IMAGE FORMING APPARATUS

CROSS-REFERENCE TO RELATED APPLICATIONS

This application claims priority to, Japanese Patent Application No. 2014-144907, filed Jul. 15, 2014, and Japanese Patent Application No. 2014-237584, filed Nov. 25, 2014, the contents of both of which are incorporated herein by reference for all purposes.

BACKGROUND OF THE INVENTION

The present invention relates to an image forming apparatus such as a printer, a facsimile machine, a copier or a multi-function peripheral having a fixing unit for fixing a toner (i.e., a developer) to a recording medium.

In a conventional image forming apparatus, a warming-up operation is performed for preheating a fixing unit before a printing operation is started. In the warming-up operation, one of two heat sources of a fixing roller is heated so as to uniformly heat a center portion and both end portions of the fixing roller in a longitudinal direction (for example, Japanese Application Publication Document No. 2012-118140).

Further, in order to prevent the fixing unit from performing a fixing operation with the excessively heated fixing roller, a cooling-down operation is performed after the printing operation is finished (for example, Japanese Application Publication Document No. 2004-102104).

In the warming-up operation or the cooling-down operation, the fixing roller is rotated in a state where the recording medium such as a continuous sheet remains in the fixing unit. Therefore, the recording medium may be transported during the warming-up operation or the cooling-down operation, and may be unnecessarily ejected.

SUMMARY OF THE INVENTION

An aspect of the present invention is intended to reduce an amount of a recording medium which is ejected during a temperature control operation of a fixing unit.

According to an aspect of the present invention, there is provided an image forming apparatus including a fixing unit including a fixing member that heats a developer for fixing the developer to a medium, a temperature control unit that heats the fixing member and controls a temperature of the fixing member, a transport member that transports the medium through the fixing unit, and a transport control unit that controls a transport speed at which the transport member transports the medium. At least one of before and after an image forming operation, the image forming apparatus performs a temperature control operation of the fixing unit while transporting the medium through the fixing unit. When the image forming apparatus performs the temperature control operation at least one of before and after the image forming operation, the transport control unit causes the transport member to transport the medium at a transport speed slower than a fastest transport speed among a plurality of preset transport speeds.

With such a configuration, it becomes possible to reduce an amount of the medium that is ejected during the temperature control operation of the fixing unit.

BRIEF DESCRIPTION OF THE DRAWINGS

In the attached drawings:

FIG. 7 is a diagram showing a configuration of a medium information managing unit according to the embodiment;

FIG. 8 is a diagram for illustrating a configuration of a printing speed managing unit according to the embodiment;

FIG. 9 is a diagram for illustrating examples of a medium weight according to the embodiment;

DETAILED DESCRIPTION OF THE PREFERRED EMBODIMENT

Hereinafter, an embodiment of the present invention will be described with reference to the drawings.

Figure 1:
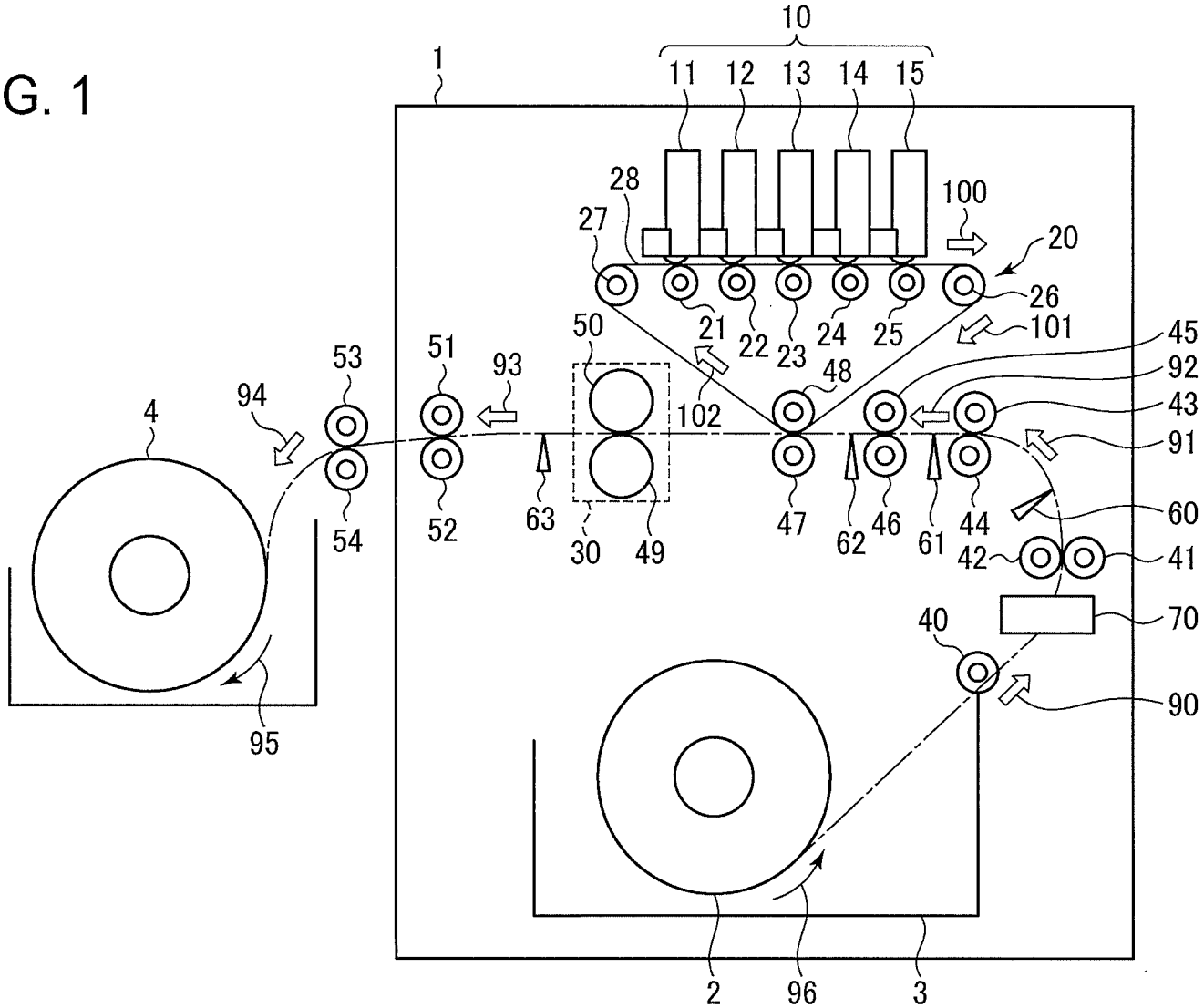
FIG. 1 is a schematic view showing a configuration of a printer according to the embodiment.

FIG. 1 is a schematic view showing a configuration of a printer 1 as an image forming apparatus according to the embodiment. In FIG. 1, the printer 1 includes a medium cassette 3, process units 10 (11, 12, 13, 14 and 15), a transfer belt unit 20, a fixing unit 30, and a cutter unit 70. The printer 1 performs a warming-up (i.e., preheating) operation and a cooling-down (i.e., heat-releasing) operation of the fixing unit 30 while transporting a recording medium 2 through the fixing unit 30. In this regard, the warming-up operation and the cooling-down operation are examples of a temperature control operation of the fixing unit 30.

The medium cassette 3 stores the recording medium 2 (i.e., a medium) in the form of a continuous sheet in such a manner that the recording medium 2 is wound in the form of a roll. In this regard, the recording medium 2 may be a label paper, a glossy paper, a transparent film or the like. The printer 1 performs printing (i.e., image formation) on the recording medium 2, and ejects the recording medium (denoted by a numeral 4). The ejected recording medium 4 is wound up in the form of a roll.

The process units 10 (11, 12, 13, 14 and 15) are electrophotographic process units. If the printer 1 is configured as a color printer, the process units 10 are provided for every color to be printed. For example, the process unit 11 is a white or transparent electrophotographic process unit. The process units 12, 13, 14 and 15 are respectively cyan, magenta, yellow and black electrophotographic process units. The process units 11, 12, 13, 14 and 15 are collectively referred to as the process units 10.

The transfer belt unit 20 is an intermediate transfer belt unit. The transfer belt unit 20 includes primary transfer rollers 21, 22, 23, 24 and 25, a driven roller 26, a driving roller 27, an intermediate transfer belt 28, and a secondary transfer roller 48.

The primary transfer rollers 21, 22, 23, 24 and 25 are provided so as to face and contact the process units 11, 12, 13, 14 and 15 via the intermediate transfer belt 28. The transfer belt 28 is an endless belt, and is rotatably wound around the driven roller 26, the driving roller 27 and the secondary transfer roller 48. A secondary transfer roller 47 is provided so as to face and contact the secondary transfer roller 48 via the intermediate transfer belt 28. The intermediate transfer belt 28 is driven by the driving roller 27 in a running (rotating) direction shown by arrows 100, 101 and 102 in FIG. 1.

The driven roller 26 applies a tension to the intermediate transfer belt 28. Developers (i.e., toners) of respective colors are transferred to the intermediate transfer belt 28 by the process units 10.

The developer transferred to the intermediate transfer belt 28 is then transferred to the recording medium 2 (transported from the medium cassette 3) by a secondary transfer section formed by the secondary transfer rollers 47 and 48.

The fixing unit 30 fixes the developer to the recording medium 2 by application of heat and pressure. The fixing unit 30 includes a fixing belt 50 and a pressure belt 49. The fixing belt 50 functions as a fixing member that heats the developer to fix the developer to the recording medium 2, and functions as a transport member that transports the medium through the fixing unit 30. Detailed description of the fixing unit 30 will be made later.

The cutter unit 70 is configured to cut the recording medium 2 fed out from the medium cassette 3 by a predetermined length.

The printer 1 further includes a pickup roller 40, registration rollers 41 and 42, and transport rollers 43 and 44. The pickup roller 40 is configured to feed the recording medium 2 from the medium cassette 3 in a direction shown by an arrow 90 in FIG. 1. The registration rollers 41 and 42 nip the recording medium 2 (fed by the pickup roller 40), and transport the recording medium 2 in a medium transport direction shown by an arrow 91 in FIG. 1. The transport rollers 43 and 44 nip the recording medium 2 (transported by the registration rollers 41 and 42), and transport the recording medium 2 in the medium transport direction shown by an arrow 92 in FIG. 1.

Transport rollers 45 and 46 are provided between the transport rollers 43 and 44 and the secondary transfer rollers 47 and 48. A timing of the secondary transfer can be controlled by starting and stopping rotations of the transport rollers 45 and 46.

Transport rollers 51 and 52 and ejection rollers 53 and 54 are provided downstream of the secondary transfer rollers 47 and 48 in the medium transport direction. The transport rollers 51 and 52 and the ejection rollers 53 and 54 respectively nip the recording medium 2, and transport the recording medium 2 (to which the developer is fixed by the fixing unit 30) in the medium transport direction as shown by arrows 93 and 94.

Further, medium passage sensors 60, 61, 62 and 63 are provided along a transport path along which the recording medium 2 is transported. The medium passage sensors 60, 61, 62 and 63 detect a passage of the recording medium 2. The medium passage sensor 60 is provided between the registration rollers 41 and 42 and the transport rollers 43 and 44. The medium passage sensor 61 is provided between the transport rollers 43 and 44 and the transport rollers 45 and 46. The medium passage sensor 62 is provided between the transport rollers 45 and 46 and the secondary transfer rollers 47 and 48. The medium passage sensor 63 is provided between the fixing unit 30 and the transport rollers 51 and 52.

Figure 2:
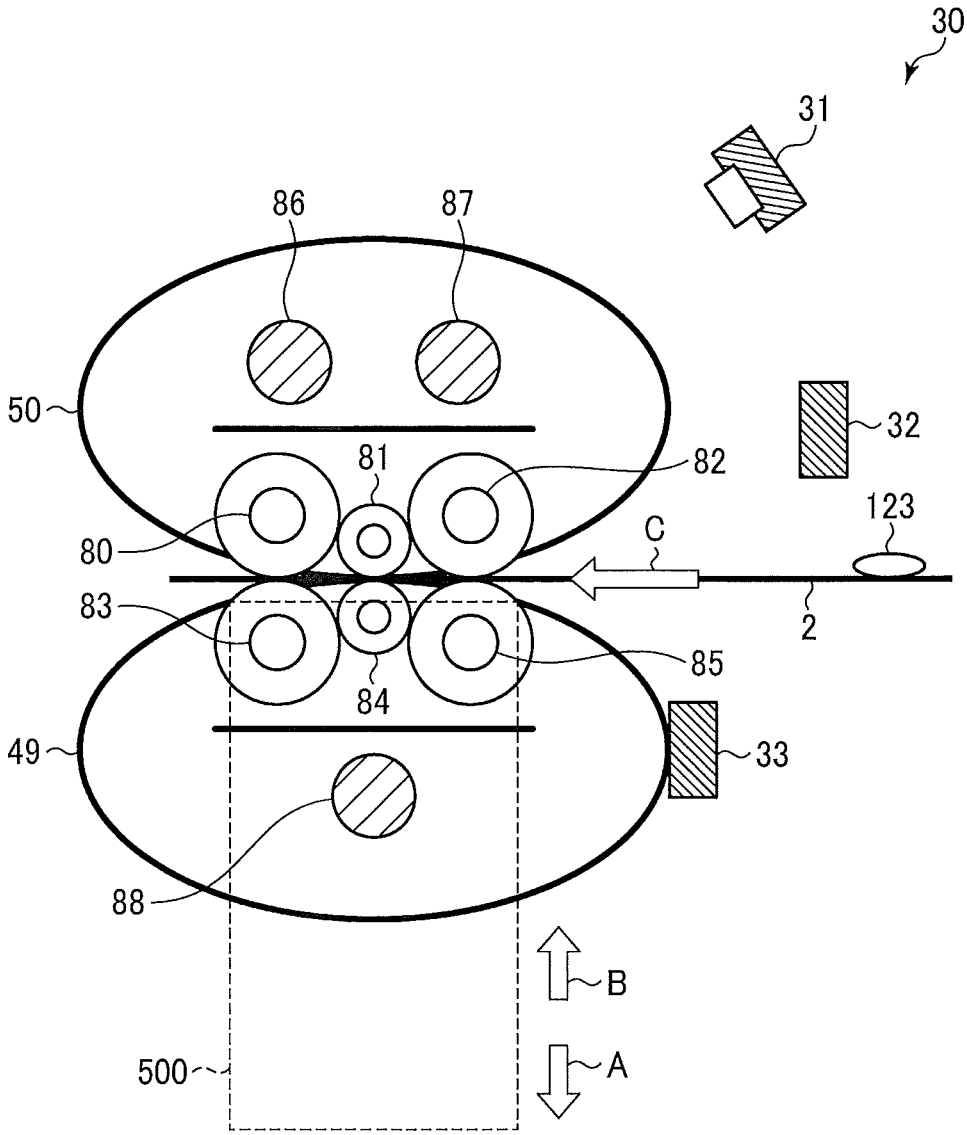
FIG. 2 is a schematic view showing a configuration of a fixing unit according to the embodiment.

FIG. 2 is a schematic view showing a configuration of the fixing unit 30 according to the embodiment. In FIG. 2, the fixing unit 30 includes a pressure belt 49, a fixing belt 50, rollers 80, 81, 82, 83, 84 and 85, heaters 86, 87 and 88, temperature detection elements 31, 32 and 33, and a separation member 500. The fixing unit 30 applies heat and pressure to the recording medium 2 (with a transferred developer 123) transported in the medium transport direction shown by an arrow C to thereby fix the developer 123 to the recording medium 2.

The pressure belt 49 and the fixing belt 50 are rotatable endless belts formed of rubber or metal such as stainless steel (SUS). The pressure belt 49 and the fixing belt 50 are nipped and pressed between the rollers 83, 84 and 85 and the rollers 80, 81 and 82. The rollers 83, 84 and 85 are provided inside the pressure belt 49. The rollers 80, 81 and 82 are provided inside the fixing belt 50. The fixing belt 50 is rotated by a driving source. The pressure belt 49 contacts an outer circumferential surface of the fixing belt 50, and rotates following a rotation of the fixing belt 50.

The separation member 500 as a separation mechanism is connected to the rollers 83, 84 and 85 contacting an inner circumferential surface of the pressure belt 49. The separation member 500 moves the pressure belt 49 and the rollers 83, 84 and 85 in a separating direction shown by an arrow A and an approaching direction shown by an arrow B with respect to the fixing belt 50 and the rollers 80, 81 and 82. When the separation member 500 moves in the separating direction shown by the arrow A, the fixing belt 50 and the pressure belt 49 move away from each other. In other words, the fixing belt 50 and the pressure belt 49 are shifted to a separation state. When the separation member 500 moves in the approaching direction shown by the arrow B, the fixing belt 50 and the pressure belt 49 contact each other. In other words, the fixing belt 50 and the pressure belt 49 are shifted to a nip state.

Heaters 86 and 87 (in this embodiment, heat sources such as halogen heaters) are provided inside the fixing belt 50. A heater 88 (in this embodiment, a heat source such as a halogen heater) is provided inside the pressure belt 49.

The temperature detection element 31 is configured to detect a surface temperature of the fixing belt 50 in a non-contact manner. The temperature detection element 31 is, for example, a thermistor, a thermopile or the like.

The temperature detection element 32 is configured to detect a surface temperature of the fixing belt 50 in a non-contact manner. The temperature detection element 32 is, for example, a thermistor, an infrared ray sensor or the like. The temperature detection element 32 is used to correct an output of the temperature detection element 31, and is used to detect an error of the temperature detection element 31.

The temperature detection element 33 is configured to detect a surface temperature of the pressure belt 49. The temperature detection element 33 may be a contact type or a non-contact type. The temperature detection element 33 is, for example, a thermistor or the like.

Figure 3:
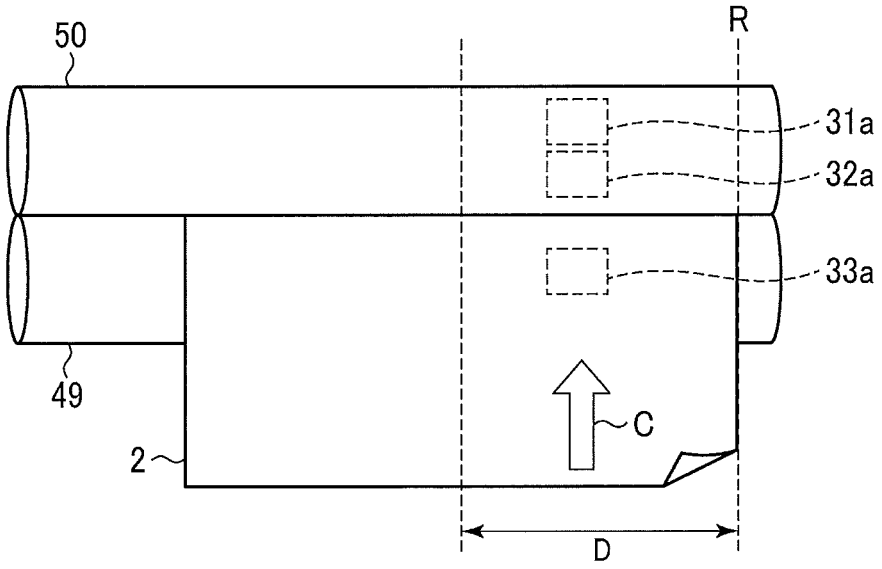
FIG. 3 is a schematic view showing areas where temperature detection elements of the fixing unit detect temperatures according to the embodiment.

FIG. 3 is a schematic view for illustrating areas where the temperature detection elements 31, 32 and 33 of the fixing unit 30 detect temperatures. FIG. 3 also shows the fixing belt 50 and the pressure belt 49 as seen in the medium transport direction shown by the arrow C.

In FIG. 3, the recording medium 2 is transported through between the fixing belt 50 and the pressure belt 49 so that edges of the fixing belt 50 and the pressure belt 49 are guided along a medium end reference portion (indicated by mark R in FIG. 3). Areas 31*a* and 32*a* where the temperature detection elements 31 and 32 detect temperatures are provided inside a minimum width (indicated by mark D in FIG. 3) in a direction perpendicular to the medium transport direction of the recording medium 2 (i.e., in a longitudinal direction of the fixing belt 50). In this embodiment, the areas 31*a* and 32*a* are provided inside the minimum sheet width D.

Further, an area 33*a* where the temperature detection element 33 detects a temperature is substantially the same as the areas 31*a* and 32*a* in the direction perpendicular to the medium transport direction of the recording medium 2 (i.e., in the longitudinal direction of the fixing belt 50).

In this way, the temperature detection elements 31 and 32 are disposed so as to detect temperatures in the areas 31*a* and 32*a*. The temperature detection element 33 is disposed so as to detect a temperature in the area 33*a*.

Figure 4:
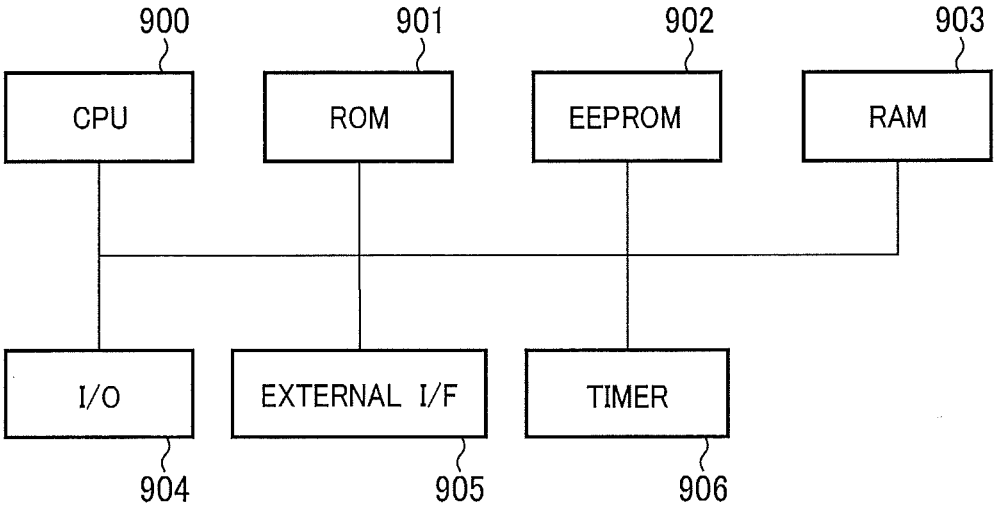
FIG. 4 is a block diagram showing a control system of a printer according to the embodiment.

FIG. 4 is a block diagram showing a configuration of a control system of the printer 1 according to the embodiment. In FIG. 4, the control system of the printer 1 includes a CPU (Central Processing Unit) 900, a ROM (Read Only Memory) 901, an EEPROM (Electrically Erasable Programmable Read Only Memory) 902, a RAM (Random Access Memory) 903, an I/O (Input/Output) unit 904, an external I/F (Interface) unit 905, and a timer 906.

The CPU 900 is a unit that controls an entire operation of the printer 1. The CPU 900 reads a control program (software) stored in the ROM 901, and executes the control program. The ROM 901 is a nonvolatile memory that stores the control program executed by the CPU 900. The EEPROM 902 is rewritable read-only memory. The RAM 903 is a memory for temporary reading and writing. The I/O unit 904 controls input and output to and from devices such as sensors, motors or the like. The external I/F unit 905 communicates with a host computer that requests the printer 1 to perform printing. The timer 906 measures a passage of time.

Figure 5:
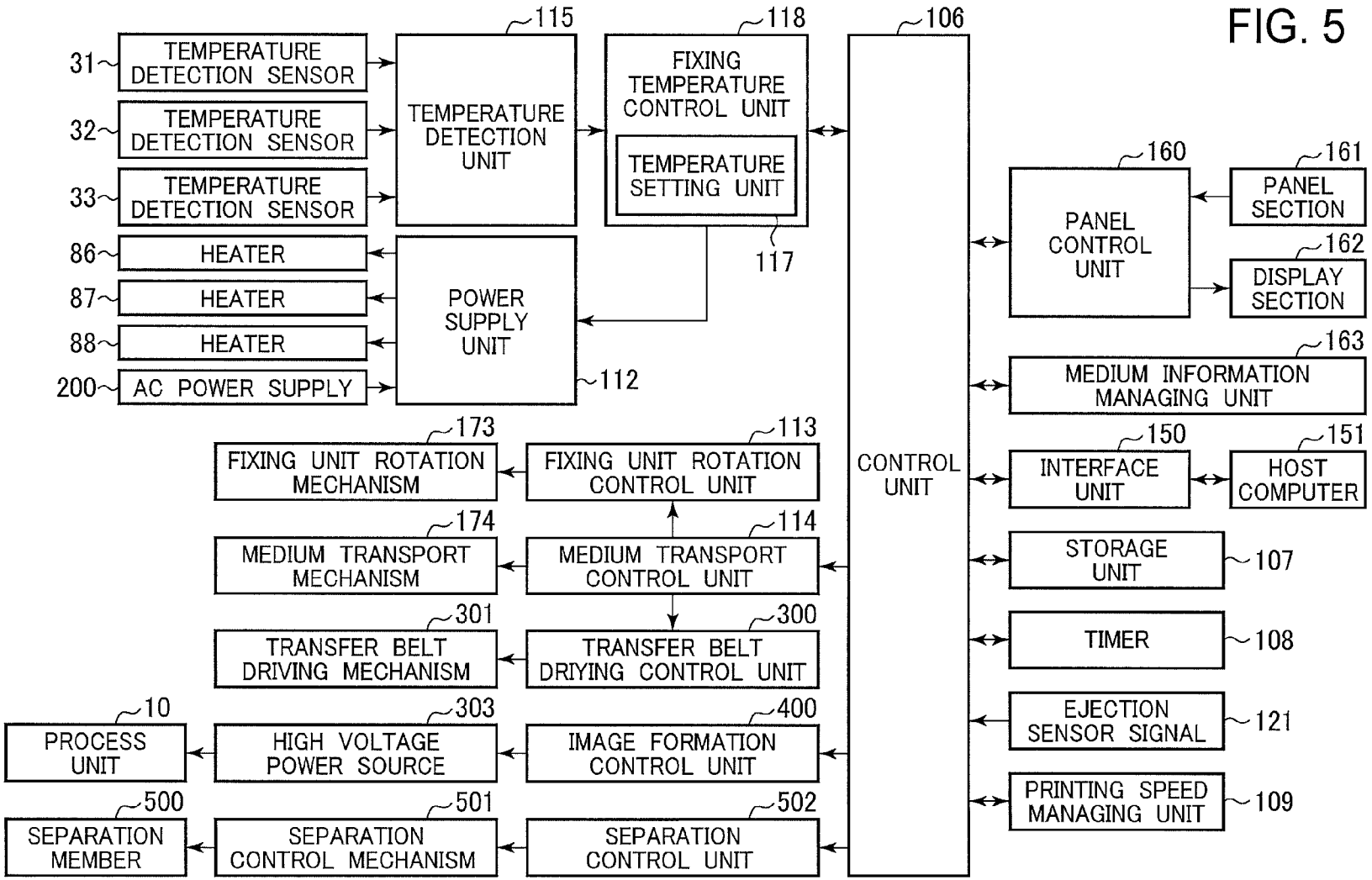
FIG. 5 is a block diagram showing a configuration for controlling the printer according to the embodiment.

FIG. 5 is a block diagram showing a configuration for controlling the printer 1 according to the embodiment. In FIG. 5, the printer 1 includes a control unit 106, a storage unit 107, a timer 108, a printing speed managing unit 109, a fixing temperature control unit 118, a medium transport control unit 114, an ejection sensor signal 121, a panel control unit 160, a medium information managing unit 163, an interface unit 150, an image formation control unit 400, and a separation control unit 502.

The control unit 106 controls an entire operation of the printer 1. The control unit 106 includes, for example, the above described control system shown in FIG. 6. Referring back to FIG. 5, the control unit 106 is connected to the storage unit 107, the timer 108, the printing speed managing unit 109, the fixing temperature control unit 118, the medium transport control unit 114, the ejection sensor signal 121, the panel control unit 160, the medium information managing unit 163, the interface unit 150, the image formation control unit 400, and the separation control unit 502.

The storage unit 107 is formed of a RAM or the like. According to an instruction of the control unit 106, the storage unit 107 stores information from a temperature setting unit 117 of the fixing temperature control unit 118, the panel control unit 160, the medium information managing unit 163, the interface unit 150, the medium transport control unit 114 and the timer 108 as necessary.

The fixing temperature control unit 118 as a temperature control unit reads surface temperatures of the fixing belt 50 and the pressure belt 49 (FIG. 2) from a temperature detection unit 115. The temperature detection unit 115 obtains the surface temperatures of the fixing belt 50 detected by the temperature detection elements 31 and 32, and the surface temperature of the pressure belt 49 detected by the temperature detection element 33.

Further, the fixing temperature control unit 118 sends a heater control signal to a power supply unit 112 to perform a heating control of the fixing belt 50 based on the surface temperature of the fixing belt 50 detected by the temperature detection unit 115 so that the surface temperature of the fixing belt 50 may approach a control target temperature Tg (among temperatures set in the temperature setting unit 117).

The temperature setting unit 117 is used to set the control target temperature Tg (for example, 165° C.). The power supply unit 112 supplies an electric power (supplied from a commercial AC power source 200) to the heaters 86, 87 and 88 based on the heater control signal outputted by the fixing temperature control unit 118.

The medium transport control unit 114 as a transport control unit performs a transport control by controlling a transport speed of the recording medium 2. To be more specific, the medium transport control unit 114 controls a medium transport mechanism 174, and outputs a driving signal to a fixing unit rotation control unit 113 to control a fixing unit rotation mechanism 173 based on a control signal from the control unit 106. Further, the medium transport control unit 114 outputs a driving signal to a transfer belt driving control unit 300 to control a transfer belt driving mechanism 301 to rotate the intermediate transfer belt 28 based on a control signal from the control unit 106.

In this regard, the fixing unit rotation control unit 113 and the transfer belt driving control unit 300 control the transport speed of the recording medium 2 by controlling driving sources (i.e., motors) such as a DC motor, a stepping motor or the like.

The image formation control unit 400 controls a high-voltage power supply unit 303 to enable the process units 10 to perform image formation using electrophotographic process based on a control signal from the control unit 106.

The separation control unit 502 controls a separation control mechanism 501 based on a control signal from the control unit 106 to move the separation member 500 (FIG. 2) in the separation direction shown by the arrow A and in the approaching direction shown by the arrow B. That is, the separation control unit 502 shifts the fixing belt 50 and the pressure belt 49 to a separation state where the fixing belt 50 and the pressure belt 49 are apart from each other, or a nip state where the fixing belt 50 and the pressure belt 49 contact each other. When the medium transport control unit 114 finishes transporting the recording medium 2, the separation control unit 502 separates the fixing belt 50 and the pressure belt 49 away from each other. When the medium transport control unit 114 starts transporting the recording medium 2, the separation control unit 502 brings the fixing belt 50 and the pressure belt 49 into contact with each other.

The panel control unit 160 receives operation information inputted by a user via a panel unit 161 as an input unit. The panel unit 161 includes, for example, button switches, a touch panel or the like. The panel control unit 160 sends the operation information (inputted via the panel unit 161) to the control unit 106, or sends display information to the display unit 162 based on the operation information inputted via the panel unit 161. The display unit 162 displays letters, figures or the like to induce a user's input based on the received operation information. The display unit 162 is, for example, an LCD (Liquid Crystal Display) panel, an LED (Light Emitting Diode) display or the like.

Figure 6:
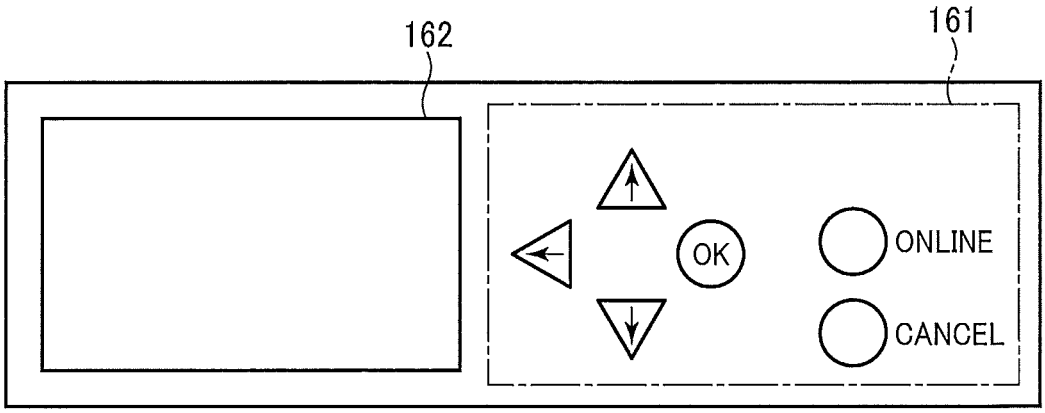
FIG. 6 is a view showing a display unit and a panel unit according to the embodiment.

The panel unit 161 and the display unit 162 are, for example, provided on an operation panel as shown in FIG. 6. The panel unit 161 includes various types of keys such as an up-arrow key, a down-arrow key, a left-arrow key and a right-arrow key for moving a cursor displayed on the display unit 162, an "OK" key for determining inputted information, an "ONLINE" key for enabling communication with a host computer 151, a "CANCEL" key for cancelling inputted information, and the like. The display unit 162 is disposed adjacent to the panel unit 161. The display unit 162 displays information for inducing the user's input, or displays information on conditions of the printer 1.

The medium information managing unit 163 manages information on the recording medium among information inputted by the user via the panel unit 161. The information on the recording medium (referred to as medium information 163*a*) includes, for example, a size of the recording medium (i.e., a medium size), a weight of the recording medium (i.e., a medium weight), a type of the recording medium (i.e., a medium type), or the like. FIG. 7 shows an example of the medium information 163*a*. The control unit 106 is able to read the medium information from the medium information managing unit 163.

The interface unit 150 (for example, the external I/F unit 905 shown in FIG. 4) controls a communication with the host computer 151 through a communication line. The interface unit 150 receives printing information from the host computer 151, notifies the control unit 106 of a reception of the printing information, and sends various information to the host computer 151 according to an instruction from the control unit 106. In this regard, the communication line may be a wired LAN (Local Area Network), a wireless LAN, an USB (Universal Serial Bus), a Centronics I/F, or the like. The timer 108 (for example, the timer 906 shown in FIG. 4) measures a passage of time.

The ejection sensor signal 121 is a signal outputted by the medium passage sensor 63 with which the control unit 106 recognizes a position of the recording medium 2 having passed the fixing unit 30 shown in FIG. 1.

The printing speed managing unit 109 stores and manages the printing speed information determined based on the medium information in the medium information managing unit 163, or information inputted by the user via the panel control unit 160. That is, the printing speed managing unit 109 is a storage unit that stores the transport speeds corresponding to the types of the recording medium. The control unit 106 controls the medium transport control unit 114 to transport the recording medium 2 based on the information in the printing speed managing unit 109.

FIG. 8 shows an example of the printing speed information 109*a* managed by the printing speed managing unit 109. The printing speed information includes information on the transport speed (ips: inch per second) of the recording medium determined based on states of the printer 1 (i.e., the printing operation, the warming-up operation or the cooling-down operation) and setting of the weight of the recording medium (i.e., the medium weight). In FIG. 8, the transport speeds of the recording medium are set in a range from 2 to 6 ips so as to correspond to the respective medium weights. As the recording medium 2 becomes thicker, the transport speed becomes slower. The transport speed of the recording medium 2 during the warming-up operation is set to 2 ips irrespective of the medium weight. Similarly, the transport speed of the recording medium 2 during the cooling-down operation is set to 2 ips irrespective of the medium weight.

In this regard, examples of the medium weight are shown in FIG. 9. When the basis weight W is smaller than or equal to 83 $g/m^2$, the recording medium is determined as a plain paper. When the basis weight W is greater than 83 $g/m^2$ and is smaller than 105 $g/m^2$, the recording medium is determined as a slightly thick paper. When the basis weight W is greater than or equal to 105 $g/m^2$ and is smaller than or equal to 120 $g/m^2$, the recording medium is determined as a thick paper. When the basis weight W is greater than 120 $g/m^2$ and is smaller than or equal to 128 $g/m^2$, the recording medium 2 is determined as a thicker paper. When the basis weight W is greater than 128 $g/m^2$, the recording medium 2 is determined as a very thick paper.

In this embodiment, the transport speeds of the recording medium 2 during the warming-up operation and the cooling-down operation are set to be the slowest transport speed among the transport speeds set for the printing operation.

A function of the printer 1 having the above described configuration will be described.

Figure 10:
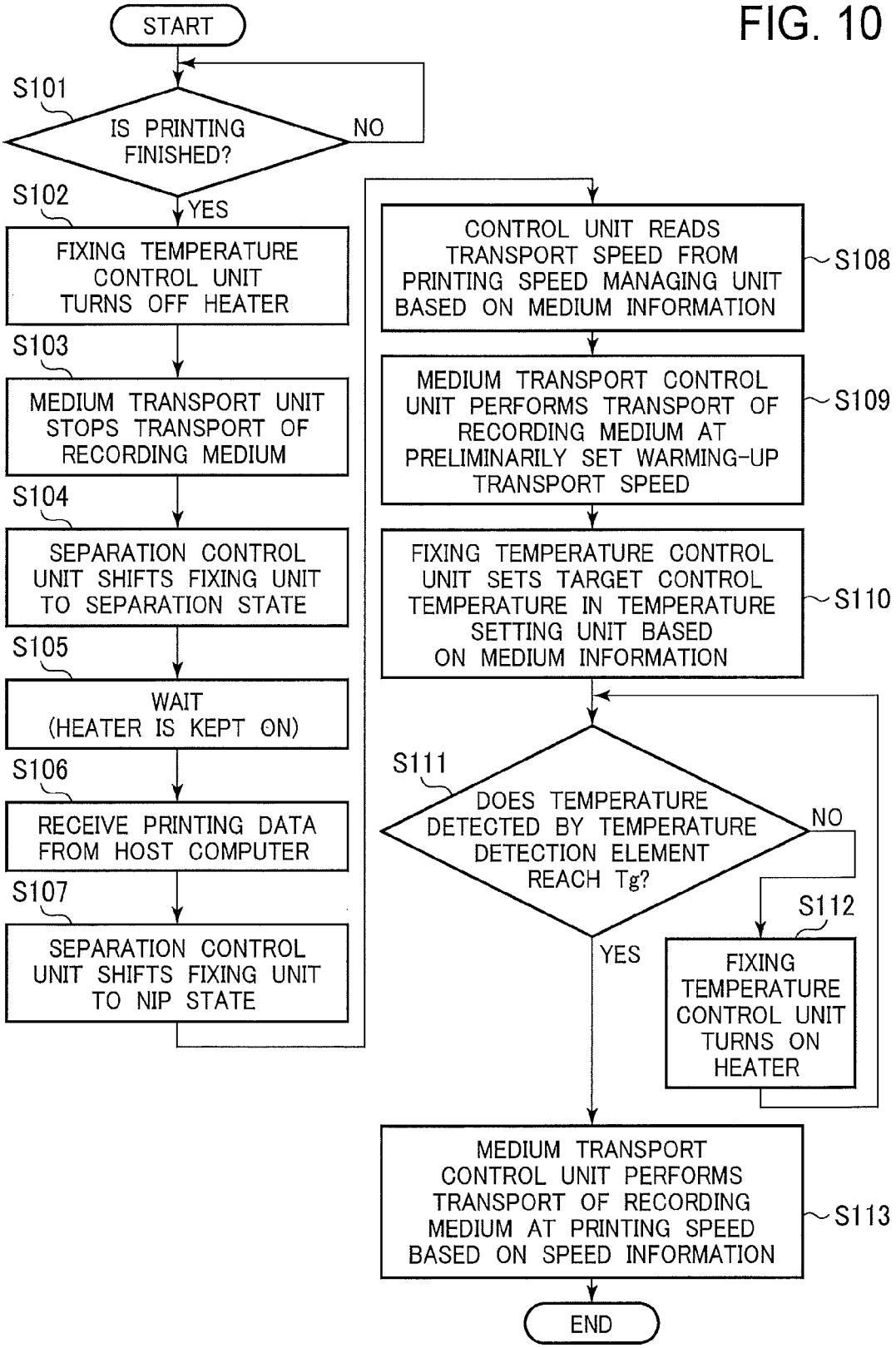
FIG. 10 is a flowchart for illustrating processing including a warming-up operation according to the embodiment.

First, processing including the warming-up operation of the fixing unit 30 will be described with reference to FIGS. 1, 2, 5 and 10. FIG. 10 is a flowchart showing the processing including the warming-up operation performed by the printer 1. Here, it is assumed that the printer 1 is performing a printing operation based on the printing information sent from the host computer 151.

In step S101, the control unit 106 of the printer 1 determines whether the printing operation is finished or not. If the control unit 106 determines that the printing operation is finished, the control unit 106 proceeds to step S102. If the control unit 106 determines that the printing operation is not yet finished, the control unit 106 waits until the printing operation is finished.

In step S102, the control unit 106 (having determined that the printing operation is finished) sends an instruction to the fixing temperature control unit 118 to turn off the heaters 86, 87 and 88. The fixing temperature control unit 118 causes the power supply unit 112 to turns off the power supply to the heaters 86, 87 and 88, so that heating of the fixing unit 30 is stopped.

In step S103, as the fixing temperature control unit 118 turns off the heaters 86, 87 and 88, the medium transport control unit 114 controls the fixing unit rotation control unit 113 and the transfer belt driving control unit 300 to stop transporting the recording medium 2, according to an instruction of the control unit 106.

In step S104, as the medium transport control unit 114 stops transporting the recording medium 2, the separation control unit 502 controls the separation control mechanism 501 to shift the fixing belt 50 and the pressure belt 49 from the nip state to the separation state where the fixing belt 50 and the pressure belt 49 are apart from each other, according to an instruction of the control unit 106. The separation control mechanism 501 causes the separation member 500 to move in the separating direction shown by the arrow A in FIG. 2, so that the fixing belt 50 and the pressure belt 49 separate from each other.

In step S105, as the separation control unit 502 separates the fixing belt 50 and the pressure belt 49 from each other, the control unit 106 enters into a stand-by mode, and the heaters 86, 87 and 88 are kept off.

In this states, the printer 1 prepares for restarting of the printing operation while the recording medium 2 in the form of a continuous sheet remains in the printer 1. Since the separation member 500 causes the separation control mechanism 501 to keep the fixing belt 50 and the pressure belt 49 apart from each other, the recording medium 2 is not damaged by the fixing belt 50 and the pressure belt 49.

In step S106, the control unit 106 (having entered into the standby mode) waits until the control unit 106 receives printing information sent from the host computer 151. When the control unit 106 receives the printing information (i.e., an instruction to perform printing) from the host computer 151 via the interface unit 150, the control unit 106 starts the warming-up operation of the fixing unit 30.

In step S107, the control unit 106 (having received the printing information) instructs the separation control unit 502 to cause the separation control mechanism 501 to shift the fixing belt 50 and the pressure belt 49 from the separation state to the nip state where the fixing belt 50 and the pressure belt 49 contact each other. The separation control mechanism 501 causes the separation member 500 to move in the approaching direction shown by the arrow B in FIG. 2, so that the fixing belt 50 and the pressure belt 49 contact each other. The pressure belt 49 becomes rotatable.

In step S108, the control unit 106 reads the printing speed information from the printing speed managing unit 109 based on the medium information stored in the medium information managing unit 163. As shown in FIG. 7, the medium information 163*a* stored in the printing speed managing unit 109 includes information on the medium type such as "label", information on the media weight such as "plain paper", and the like. This information is preset based on the user's input via the display unit 162 and the panel unit 161 (FIG. 6) controlled by the panel control unit 160.

In this regard, if the medium information stored in the medium information managing unit 163 is different from the medium information used in the previous printing operation finished in step S101, the control unit 106 does not perform the warming-up operation.

In step S109, the medium transport control unit 114 transports the recording medium 2 at a transport speed (for example, 2 ips) which is preset for the warming-up operation in the printing speed information 109*a* (FIG. 8) stored in the printing speed managing unit 109, according to an instruction of the control unit 106 having read the printing speed information. Hereinafter, the transport speed which is preset for the warming-up operation is referred to a warming-up transport speed.

In this embodiment, the transport speed of the recording medium 2 during the warming-up operation is the warming-up transport speed which is set in the printing speed information 109*a* shown in FIG. 8. However, the transport speed of the recording medium 2 during the warming-up operation may be the slowest transport speed among the transport speeds set for the printing operation in the printing speed information 109*a*.

In step S110, the fixing temperature control unit 118 sets the control target temperature Tg in the temperature setting unit 117 based on the medium information stored in the medium information managing unit 163, according to an instruction of the control unit 106.

In step S111, the fixing temperature control unit 118 determines whether the temperature detected by the temperature detection element 31 reaches the control target temperature Tg based on the temperature information from the temperature detection unit 115. If the detected temperature reaches the control target temperature Tg, the fixing temperature control unit 118 proceeds to step S113. If the detected temperature does not reach the control target temperature Tg, the fixing temperature control unit 118 proceeds to step S112.

In step S112, the fixing temperature control unit 118 (having determined that the temperature detected by the temperature detection element 31 does not reach the control target temperature Tg) causes the power supply unit 112 to turn on the heaters 86, 87 and 88 to thereby start heating the fixing unit 30, and proceeds to the step S111. The heating of the fixing unit 30 is performed in a state where the recording medium 2 is transported under control of the medium transport control unit 114.

Figure 11:
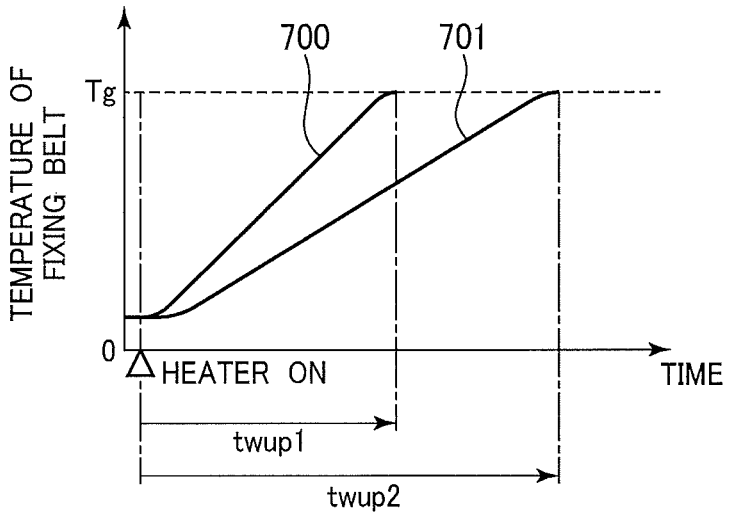
FIG. 11 is a graph for illustrating a temperature change of a fixing belt according to the embodiment.

Here, a temperature change of the fixing belt 50 will be described with reference to FIG. 11. FIG. 11 is a graph showing a relationship between the temperature of the fixing belt 50 and an elapsed time after the heaters 86, 87 and 88 are turned on and before the temperature of the fixing belt 50 reaches the control target temperature Tg. A vertical axis indicate the temperature of the fixing belt 50, and a horizontal axis indicates the elapsed time.

A temperature curve 700 represents a temperature change of the fixing belt 50 in the case where the warming-up operation is performed while setting the transport speed of the recording medium 2 to the low speed (2 ips), i.e., the warming-up transport speed. In this case, a time elapsed after the heaters 86, 87 and 88 are turned on and before the temperature of the fixing belt 50 reaches the control target temperature Tg is expressed as twup1.

In contrast, a temperature curve 701 represents a temperature change of the fixing belt 50 in the case where the warming-up operation is performed while setting the transport speed of the recording medium 2 to the transport speed (6 ips) which is the transport speed for the printing operation. In this case, a time elapsed after the heaters 86, 87 and 88 are turned on and before the temperature of the fixing belt 50 reaches the control target temperature Tg is expressed as twup2.

Figure 12:
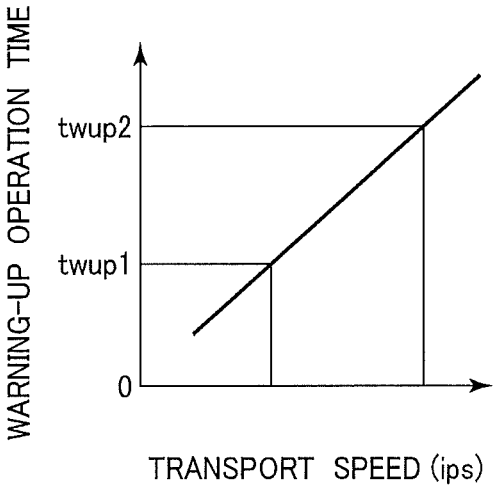
FIG. 12 is a graph for illustrating a relationship between a warming-up operation time and a transport speed of a recording medium according to the embodiment.

A relationship between twup1 and twup2 is expressed as twup1<twup2. In the fixing unit 30 shown in FIG. 2, when the transport speed of the recording medium 2 is low, an amount of heat (generated by the heaters 86 and 87) taken from the fixing belt 50 decreases, and therefore a time required for the warming-up operation can be reduced. This relationship can be expressed by a graph shown in FIG. 12. In FIG. 12, as the transport speed of the recording medium 2 becomes slower, the time required for the warming-up operation (i.e., a warming-up operation time) becomes shorter.

Figure 13:
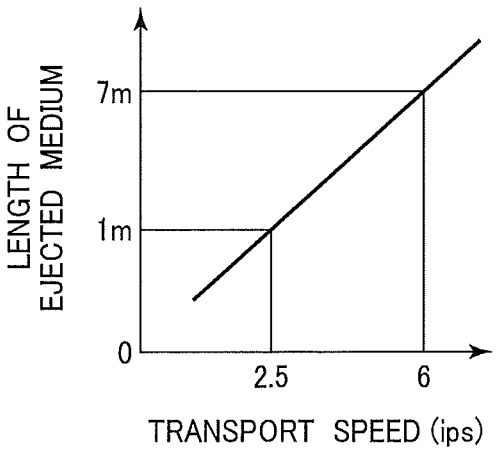
FIG. 13 is a graph for illustrating a relationship between a length of an ejected recording medium and the transport speed of the recording medium during the warming-up operation according to the embodiment.

FIG. 13 is a graph showing a relationship between a length (i.e., amount) of the ejected recording medium and the transport speed of the recording medium 2. For example, when the warming-up operation of the fixing unit 30 is performed while setting the transport speed of the recording medium 2 to 2.5 ips, the length of the ejected recording medium is 1 m. In contrast, when the warming-up operation of the fixing unit 30 is performed while setting the transport speed of the recording medium 2 to 6 ips, the length of the ejected recording medium is 7 m. Therefore, in order to reduce the length of the ejected recording medium, it is necessary to reduce the transport speed of the recording medium 2.

In step S113, if the fixing temperature control unit 118 determines that the temperature detected by the temperature detection element 31 reaches the control target temperature Tg in the above described step S111, the control unit 106 reads the printing speed information for the printing operation from the printing speed managing unit 109 based on the medium information in the medium information managing unit 163. According to an instruction of the control unit 106 (having read the printing speed information for the printing operation), the medium transport control unit 114 transports the recording medium 2 at the transport speed (for example, 6 ips) which is preset for the printing operation in the printing speed managing unit 109. Then, the processing shown in FIG. 10 is finished.

In this way, the control unit 106 causes the medium transport control unit 114 to transport the recording medium 2 at the warming-up transport speed (for example, 2 ips) which is the slowest transport speed among the transport speeds preset in the printing speed managing unit 109. While the recording medium 2 is transported at this transported speed, the fixing temperature control unit 118 causes the power supply unit 112 to turn on the heaters 86, 87 and 88 so as to heat the fixing unit 30. Therefore, it becomes possible to reduce the length (amount) of the recording medium ejected during the warming-up (i.e., preheating) operation of the fixing unit 30 before the printing operation is started.

Figure 14:
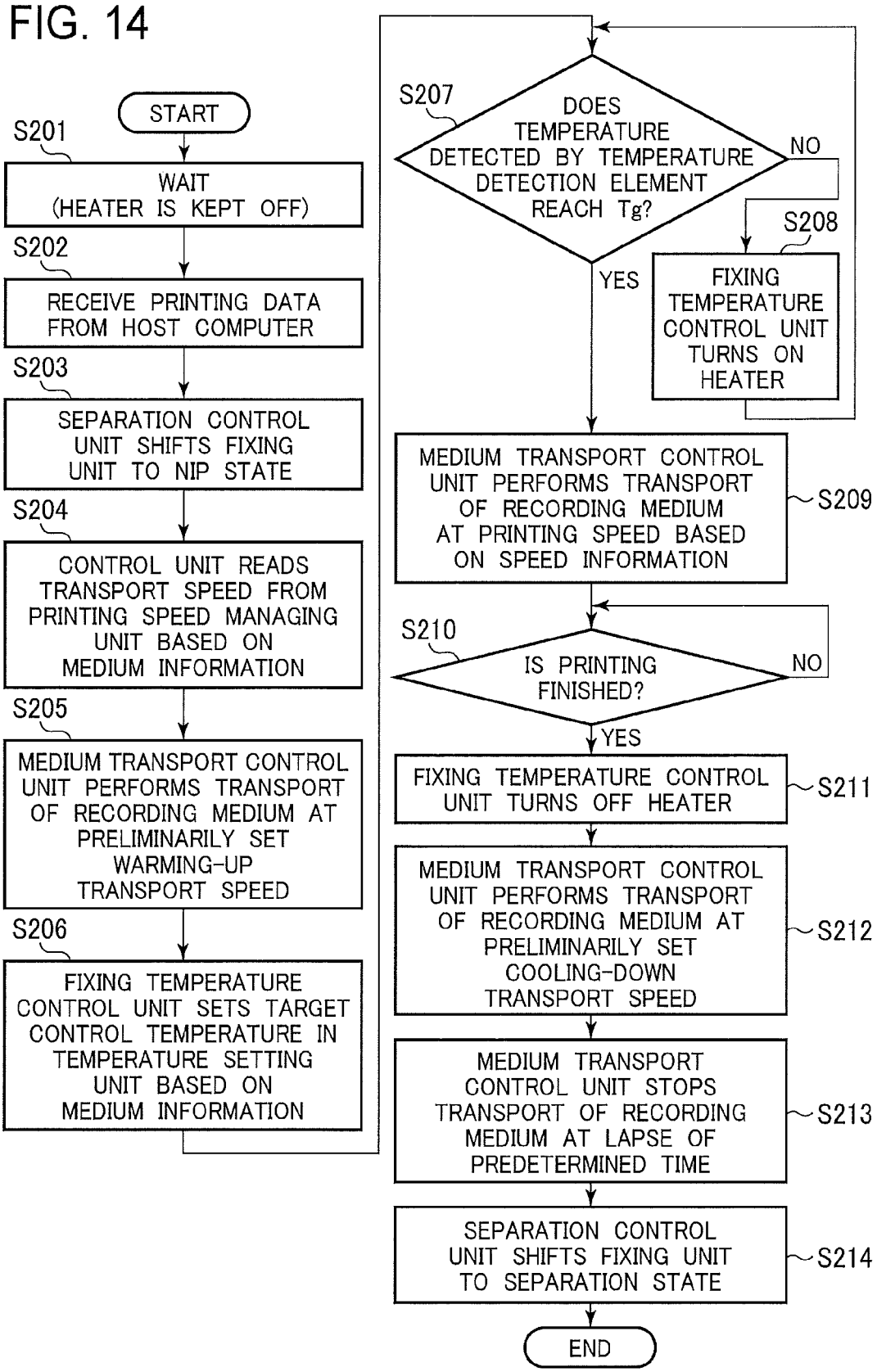
FIG. 14 is a flowchart for illustrating processing including a cooling-down operation according to the embodiment.

Next, processing including the cooling-down operation of the fixing unit 30 will be described with reference to FIGS. 1, 2, 5 and 14. FIG. 14 is a flowchart for illustrating the processing including the cooling-down operation performed by the printer 1. Here, it is assumed that the printer 1 performs the printing operation based on the printing information sent from the host computer 151.

In step S201, the printer 1 is in the standby mode. The fixing temperature control unit 118 keeps the heaters 86, 87 and 88 off according to an instruction of the control unit 106. That is, the fixing temperature control unit 118 causes the power supply unit 112 to keep the heaters 86, 87 and 88 off.

In this state, the printer 1 prepares for restarting of the printing operation while the recording medium 2 in the form of a continuous sheet remains in the printer 1. Since the separation member 500 causes the separation control mechanism 501 to keep the fixing belt 50 and the pressure belt 49 apart from each other, the recording medium 2 is not damaged by the fixing belt 50 and the pressure belt 49.

In step S202, the control unit 106 (having entered into the stand-by mode) waits until the control unit 106 receives printing information from the host computer 151. When the control unit 106 receives the printing information (i.e., an instruction to perform printing) from the host computer 151 via the interface unit 150, the control unit 106 starts the above described warming-up operation of the fixing unit 30.

In step S203, the control unit 106 (having received the printing information) instructs the separation control unit 502 to cause the separation control mechanism 501 to shift the fixing belt 50 and the pressure belt 49 from the separation state to the nip state where the fixing belt 50 and the pressure belt 49 contact each other. The separation control mechanism 501 causes the separation member 500 to move in the approaching direction shown by the arrow B in FIG. 2, so that the fixing belt 50 and the pressure belt 49 contact each other. The pressure belt 49 becomes rotatable.

In step S204, the control unit 106 reads the printing speed information from the printing speed managing unit 109 based on the medium information stored in the medium information managing unit 163. As shown in FIG. 7, the medium information 163*a* stored in the printing speed managing unit 109 includes information on the medium type such as "label", information on the media weight such as "plain paper", and the like.

In step S205, the medium transport control unit 114 transports the recording medium 2 at the warming-up transport speed (for example, 2 ips) set in the printing speed information 109*a* (FIG. 8) stored in the printing speed managing unit 109, according to an instruction of the control unit 106 having read the printing speed information.

In step S206, the fixing temperature control unit 118 sets the control target temperature Tg in the temperature setting unit 117 based on the medium information stored in the medium information managing unit 163, according to an instruction of the control unit 106.

In step S207, the fixing temperature control unit 118 determines whether the temperature detected by the temperature detection element 31 reaches the control target temperature Tg based on the temperature information from the temperature detection unit 115. If the detected temperature reaches the control target temperature Tg, the fixing temperature control unit 118 proceeds to step S209. If the detected temperature does not reach the control target temperature Tg, the fixing temperature control unit 118 proceeds to step S208.

In step S208, the fixing temperature control unit 118 (having determined that the temperature detected by the temperature detection element 31 does not reach the control target temperature Tg) causes the power supply unit 112 to turn on the heaters 86, 87 and 88 to thereby start heating the fixing unit 30, and proceeds to step S207. The heating of the fixing unit 30 is performed in a state where the recording medium 2 is transported under control of the medium transport control unit 114.

In step S209, if the fixing temperature control unit 118 determines that the temperature detected by the temperature detection element 31 reaches the control target temperature Tg in the above described step S207, the control unit 106 reads the printing speed information for the printing operation from the printing speed managing unit 109 based on the medium information of the medium information managing unit 163. According to an instruction of the control unit 106 (having read the printing speed information for the printing operation), the medium transport control unit 114 transports the recording medium 2 at the printing speed (for example, 6 ips) which is preset for the printing operation in the printing speed managing unit 109, and the printing operation is performed.

In step S210, the control unit 106 of the printer 1 determines whether the printing operation is finished or not. If the control unit 106 determines that the printing operation is finished, the control unit 106 proceeds to step S211 to perform the cooling-down operation. If the control unit 106 determines that the printing operation is not yet finished, the control unit 106 waits until the printing operation is finished.

In step S211, the control unit 106 (having determined that the printing operation is finished) sends an instruction to the fixing temperature control unit 118 to turn off the heaters 86, 87 and 88. The fixing temperature control unit 118 controls the power supply unit 112 to turn off the power supply to the heaters 86, 87 and 88, and the heating of the fixing unit 30 is stopped.

In step S212, the medium transport control unit 114 transports the recording medium 2 at the transport speed which is preset for the cooling-down operation (referred to as a cooling-down transport speed) in the printing speed managing unit 109, according to an instruction of the control unit 106. For example, the medium transport control unit 114 transports the recording medium 2 at the cooling-down transport speed (for example, 2 ips) included in the printing speed information 109*a* shown in FIG. 8 irrespective of media weight, and performs the cooling-down operation to release heat from the fixing unit 30.

The cooling-down operation is performed in order to prevent a temperature unevenness of the fixing belt 50 in the rotating direction of the fixing belt 50. Such a temperature unevenness of the fixing belt 50 may be caused by a rapid temperature increase of the fixing belt 50 heated by elements such as the heaters 86 and 87 (provided inside the fixing belt 50) when the printing operation is finished and the transport of the recording medium 2 is stopped.

In this cooling-down operation, the recording medium 2 is transported until the temperatures of the heaters 86 and 87 are lowered to a predetermined temperature.

In step S213, when a predetermined time (for example, 10 seconds) elapses after the fixing temperature control unit 118 turns off the heaters 86, 87 and 88, the medium transport control unit 114 causes the fixing unit rotation control unit 113 and the transfer belt driving control unit 300 to stop transporting the recording medium 2, according to an instruction of the control unit 106.

Figure 15A:
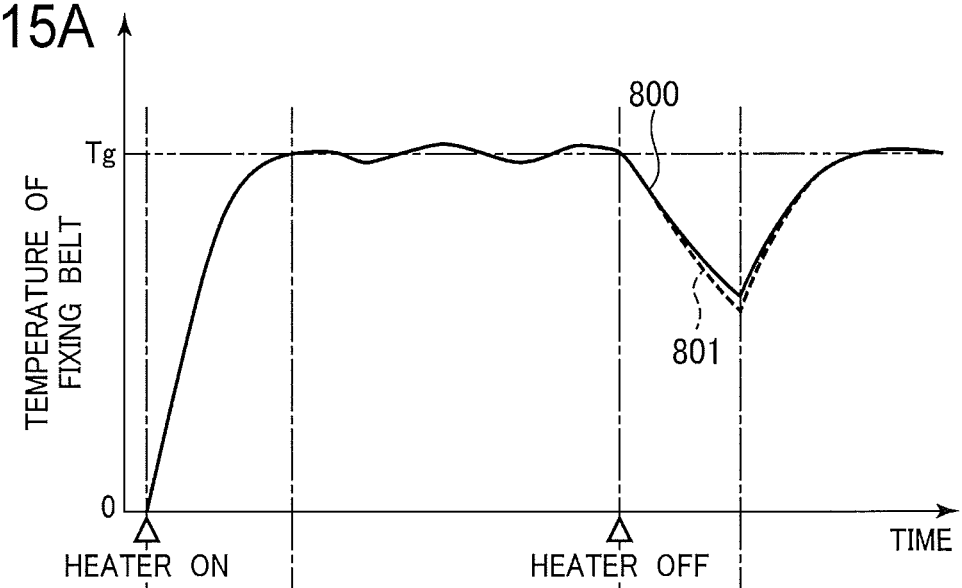
FIGS. 15A and 15B are diagrams for illustrating a temperature change of the fixing belt according to the embodiment.
Figure 15B:
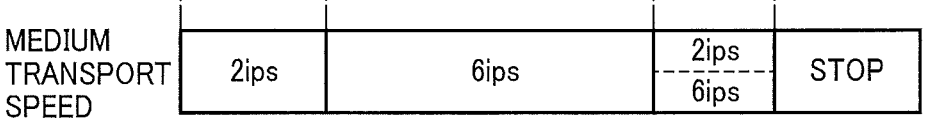

FIGS. 15A and 15B are diagrams for illustrating a temperature change of the fixing belt 50. FIG. 15A shows a relationship between the temperature of the fixing belt 50 and an elapsed time after the printing operation is started and before the printing operation is finished. FIG. 15B shows the transport speed of the recording medium 2.

In FIG. 15A, a solid line 800 indicates a temperature curve that represents a temperature change of the fixing belt 50 in the case where the cooling-down operation is performed while setting the transport speed (FIG. 15B) of the recording medium 2 to the low speed (2 ips). A broken line 801 indicates a temperature curve that represents a temperature change of the fixing belt 50 in the case where the cooling-down operation is performed while setting the transport speed (FIG. 15B) of the recording medium 2 to the transport speed for the printing operation, i.e., the printing speed (6 ips).

In the case where the transport speed is set to the printing speed (6 ips) as shown by the broken line 801, a temperature decrease of the fixing belt 50 is slightly larger than the case where the transport speed is set to the low speed (2 ips) as shown by the solid line 800. This is because factors (for example, a transport distance of the recording medium 2) that takes heat from the fixing belt 50 increase as the transport speed of the recording medium 2 increases. However, since heat is accumulated in the rollers 80, 81 and 82 provided inside the fixing belt 50, a difference between temperatures of both cases does not become large.

Further, the temperatures of the heaters 86 and 87 are much higher than the temperature of the fixing belt 50. Therefore, after the transport of the recording medium 2 is stopped, the temperature of the fixing belt 50 increases to substantially the same level irrespective of whether the transport speed is 2 ips (as shown by the solid line 800) or 6 ips (as shown by the broken line 801). In this regard, an increase in the transport speed of the recording medium 2 causes a decrease in the temperatures of the fixing belt 50 and the rollers 80, 81 and 82, but does not influence the temperatures of the heaters 86 and 87.

The heaters 86 and 87 are cooled only by outside air flowing into inside of the fixing belt 50. In this embodiment, the temperatures of the heaters 86 and 87 are 500° C. when the printing operation is finished. The temperatures of the heaters 86 and 87 are 400° C. when 10 seconds elapse after the printing operation is finished. The temperatures of the heaters 86 and 87 do not change irrespective of whether the transport speed of the recording medium 2 is the low speed (2 ips) or the printing speed (6 ips). Therefore, after the transport of the recording medium 2 is stopped, the temperature of the fixing belt 50 is increased by the heat of the heaters 86 and 87 to substantially the same temperature irrespective of the transport speed of the recording medium 2.

Figure 16:
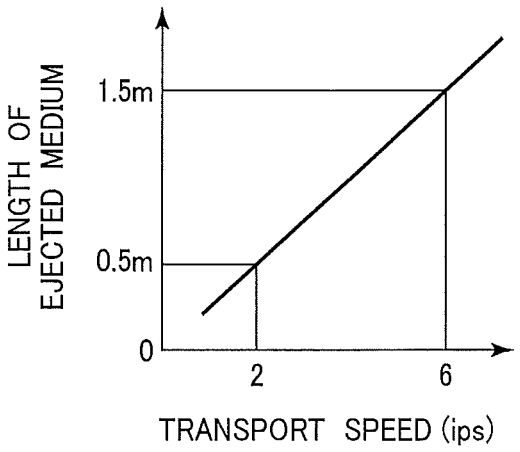
FIG. 16 is a graph for illustrating a relationship between a length of an ejected recording medium and the transport speed of the recording medium during the cooling-down operation according to the embodiment.

FIG. 16 is a graph showing a relationship between the transport speed of the recording medium 2 and the length (amount) of the ejected recording medium during the cooling-down operation. For example, when the cooling-down operation is performed while setting the transport speed to 2 ips, the length of the ejected recording medium is almost 0.5 m. However, when the cooling-down operation is performed while setting the transport speed to 6 ips, the length of the ejected recording medium is almost 1.5 m. Therefore, in order to reduce the length of the ejected recording medium during the cooling-down operation, it is necessary to reduce the transport speed.

Figure 17:
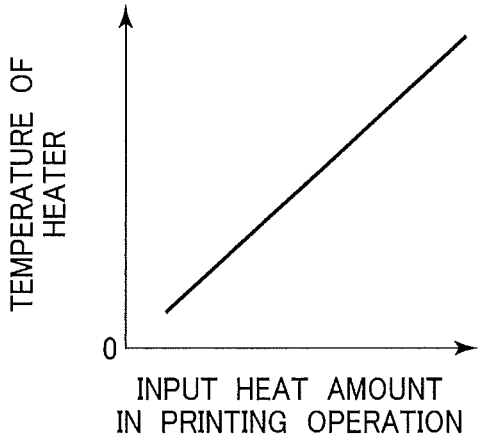
FIG. 17 is a graph for illustrating a relationship between a temperature of a heater and an input heat amount in a printing operation according to the embodiment.
Figure 18:
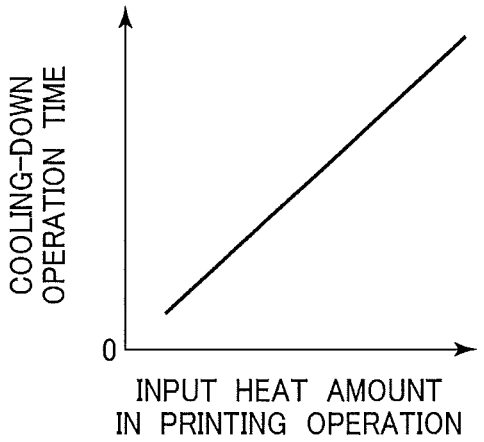
FIG. 18 is a graph for illustrating a relationship between a cooling-down operation time and the input heat amount in the printing operation according to the embodiment.

A cooling-down operation time is defined as a time after the heaters 86, 87 and 88 are turned off and before the transport of the recording medium 2 is stopped by the fixing unit rotation control unit 113 and the transfer belt driving control unit 300 in step S213. In this embodiment, the cooling-down operation time is set to 10 seconds. However, an input heat amount in the printing operation and the temperature of the heater are in a relationship as shown in FIG. 17, and therefore it is also possible to set the cooling-down operation time by calculation based on a relationship between the input heat amount in the printing operation and the cooling-down operation time as shown in FIG. 18.

In step S214, when the medium transport control unit 114 stops transporting the recording medium 2, the separation control unit 502 causes the separation control mechanism 510 to shift the fixing belt 50 and the pressure belt 49 from the nip state to the separation state. The separation control mechanism 510 causes the separation member 500 to move in the separating direction shown by the arrow A in FIG. 2 so that the fixing belt 50 and the pressure belt 49 are apart from each other. Then, the processing of FIG. 14 is finished.

In this way, the control unit 106 causes the medium transport control unit 114 to transport the recording medium 2 at the cooling-down transport speed (for example, 2 ips) which is the slowest transport speed among the transport speeds preset in the printing speed managing unit 109. When a predetermined time (for example, 10 seconds) elapses after the fixing temperature control unit 118 turns off the heaters 86, 87 and 88, the control unit 106 causes the fixing unit rotation control unit 113 and the transfer belt driving control unit 300 to stop transporting the recording medium 2. Therefore, it becomes possible to reduce the length (amount) of the ejected recording medium during the cooling-down (i.e., heat-releasing) operation of the fixing unit 30 after the printing operation.

In this embodiment, description has been made of an example in which the recording medium 2 is transported at the slowest transport speed among the preset transport speeds. However, there may be a case where a vibration (resonance) occurs when the recording medium 2 is transported at the slowest transport speed, depending on environment where the printer 1 is installed or the like. In such a case, it is not necessary to transport the recording medium 2 at the slowest transport speed. It is only necessary to transport the recording medium 2 at the transport speed which is slower than the fastest transport speed. The fastest transport speed is a normal transport speed in the printing operation. Even in such a case, the amount of the ejected recording medium can be reduced.

Further, by transporting the recording medium 2 at the transport speed slower than the fastest transporting speed among the preset transport speeds in at least one of the warming-up operation and the cooling-down operation (i.e., the temperature control operation of the fixing unit 30), the length of the ejected recording medium can be reduced.

Furthermore, by transporting the recording medium 2 at the transport speed slower than the fastest transporting speed among the preset transport speeds in both of the warming-up operation and the cooling-down operation, the length of the ejected recording medium can be further reduced.

As described above, according to the embodiment of the present invention, the warming-up operation of the fixing unit 30 is performed while transporting the recording medium 2 at the transport speed slower than the fastest transporting speed among the preset transport speeds. Therefore, the warming-up operation time can be shortened, and the length of the ejected recording medium can be reduced.

Further, the cooling-down operation of the fixing unit 30 is performed while transporting the recording medium 2 at the transport speed slower than the fastest transporting speed among the predetermine transport speeds. Therefore, the cooling-down operation time can be shortened, and the length of the ejected recording medium can be reduced.

In the above described embodiment, the printer has been described as an example of the image forming apparatus. However, the present invention is also applicable to a copier, a facsimile machine, a multi-function peripheral (MFT) or the like having a fixing unit.

While the preferred embodiments of the present invention have been illustrated in detail, it should be apparent that modifications and improvements may be made to the invention without departing from the spirit and scope of the invention as described in the following claims.

What is claimed is:

1. An image forming apparatus comprising:

a fixing unit including a fixing member that heats a developer to fix the developer to a medium;

a temperature control unit that heats the fixing member and controls a temperature of the fixing member;

a transport member that transports the medium through the fixing unit; and a transport control unit that controls a transport speed at which the transport member transports the medium, wherein an image forming operation is stopped in a state where the fixing member contacts the medium and then started in the state where the fixing member contacts the medium, at least one of before and after the image forming operation, a temperature control operation of the fixing unit is performed while transporting the medium through the fixing unit, and the transport control unit causes the transport member to transport the medium at a transport speed slower than a fastest transport speed among a plurality of preset transport speeds when the temperature control operation is performed at least one of before and after the image forming operation.

2. The image forming apparatus according to claim 1, wherein the transport control unit causes the transport member to transport the medium at the transport speed slower than the fastest transport speed among the plurality of preset transport speeds when the image forming apparatus performs a preheating operation of the fixing unit before the image forming operation.

3. The image forming apparatus according to claim 1, wherein the transport control unit causes the transport member to transport the medium at the transport speed slower than the fastest transport speed among the plurality of preset transport speeds when the image forming apparatus performs a heat-releasing operation of the fixing unit after the image forming operation.

4. The image forming apparatus according to claim 1, wherein the transport control unit causes the transport member to transport the medium at the transport speed, which is slower than a transport speed at which the image forming operation is performed on a plain paper among the plurality of preset transport speeds.

5. The image forming apparatus according to claim 1, wherein the transport control unit causes the transport member to transport the medium at a slowest transport speed among the plurality of preset transport speeds.

6. The image forming apparatus according to claim 1, wherein the fixing unit includes:

an endless and rotatable fixing belt as the fixing member, and an endless and rotatable pressure belt that contacts an outer circumferential surface of the fixing belt; and the image forming apparatus further comprises a separation mechanism that brings the fixing belt and the pressure belt into contact with each other, or separates the fixing belt and the pressure belt away from each other.

7. The image forming apparatus according to claim 6, further comprising a separation control unit that controls the separation mechanism, wherein the separation control unit causes the separation mechanism to separate the fixing belt and the pressure belt away from each other when the transport control unit finishes transporting the medium, and the separation control unit causes the separation mechanism to bring the fixing belt and the pressure belt into contact each other when the transport control unit starts transporting the medium.

8. The image forming apparatus according to claim 1, further comprising a storage unit that stores transport speeds corresponding to types of media, wherein the transport control unit causes the transport member to transport the medium at a slowest transport speed among the transport speeds stored in the storage unit when the image forming apparatus performs the temperature control operation.

9. The image forming apparatus according to claim 1, wherein the temperature control operation is a warming-up operation of the fixing unit when the temperature control operation is performed before the image forming operation.

10. The image forming apparatus according to claim 1, wherein the temperature control operation is a cooling-down operation of the fixing unit when the temperature control operation is performed after the image forming operation.

11. The image forming apparatus according to claim 1, wherein the transport control unit causes the transport member to transport the medium at a constant transport speed, which is slower than the fastest transport speed, for a predetermined time period when the image forming apparatus performs the temperature control operation.

12. The image forming apparatus according to claim 1, wherein the temperature control operation includes a warming-up operation of the fixing unit being performed before the image forming operation, and a cooling-down operation of the fixing unit being performed after the image forming operation.

13. The image forming apparatus according to claim 1, wherein the medium is of a continuous sheet type.

* * * * *